US008584636B2

(12) United States Patent
David et al.

(10) Patent No.: US 8,584,636 B2
(45) Date of Patent: Nov. 19, 2013

(54) VALVE TRAIN WITH VARIABLE CAM PHASER

(75) Inventors: Pascal David, Beidweiler (LU); Pierre Kimus, Attert (BE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/392,985

(22) PCT Filed: Aug. 9, 2010

(86) PCT No.: PCT/EP2010/061549

§ 371 (c)(1), (2), (4) Date: Apr. 11, 2012

(87) PCT Pub. No.: WO2011/023525

PCT Pub. Date: Mar. 3, 2011

(65) Prior Publication Data

US 2012/0186548 A1 Jul. 26, 2012

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,474,499 | A | 12/1995 | Olson | |
| 6,216,654 | B1 * | 4/2001 | Regueiro | 123/90.15 |
| 7,421,990 | B2 * | 9/2008 | Taye et al. | 123/90.17 |
| 2003/0226532 | A1 | 12/2003 | Takenaka et al. | |
| 2007/0169731 | A1 | 7/2007 | Farah et al. | |
| 2009/0007863 | A1 * | 1/2009 | Matsuda | 123/90.14 |

FOREIGN PATENT DOCUMENTS

| | | |
|---|---|---|
| DE | 102007000809 | 4/2008 |
| EP | 1715143 | 10/2006 |
| GB | 2354553 | 3/2001 |

* cited by examiner

*Primary Examiner* — Zelalem Eshete
(74) *Attorney, Agent, or Firm* — Thomas N. Twomey

(57) ABSTRACT

A valve train for an internal combustion engine includes a camshaft and a variable cam phaser connected to the camshaft for driving the camshaft. The variable cam phaser includes an input shaft rotationally coupled to a crankshaft drive member; and an output shaft rotationally coupled to the camshaft and coaxial with the input shaft. Electrically operated adjusting means drivingly connect the input and output shafts enabling the input and output shafts to be selectively, angularly adjusted while maintaining driving engagement therebetween. The input and output shafts are coupled to the drive member and camshaft via respective, rotationally stiff, flexible couplings.

11 Claims, 2 Drawing Sheets

VALVE TRAIN WITH VARIABLE CAM PHASER

FIELD OF THE INVENTION

The present invention generally relates to the field of internal combustion engines and more specifically to a valve train with variable cam phaser for adjusting the phase of the engine camshaft.

BACKGROUND OF THE INVENTION

As it is well known, a variable cam phaser is used to change the cam lobe (valve lift event) timing to crankshaft timing while the engine is running, based on the parameters of the engine. Thereby, optimum values for fuel consumption and exhaust emissions can be obtained in different areas of the engine's operating characteristics. An elegant manner of varying the valve timing is realized by rotating the camshaft relative to its driving member, typically a sprocket wheel or pulley connected to the crankshaft via a chain, respectively a toothed belt.

Various types of cam phasers capable of achieving this exist. Conventional cam phasers employ hydraulic actuators using high-pressure oil to enable relative angular displacement between drive and driven members. Unfortunately, hydraulic systems have difficulty operating at extremes of temperature, in particular during engine start up when the oil is cold, due to temperature related viscosity changes of the oil.

To avoid such problems, more recent designs of cam phasers employ electric actuators in a configuration allowing their mounting at one end of the camshaft. The cam phaser typically has coaxial input and output members, the input member being coupled to the engine's sprocket wheel to act as drive member, while the output member is coupled to the camshaft. In practice, the sprocket wheel often has an extension with a toothed portion that meshes with a pinion forming the cam phaser's input member and the output member is screwed directly onto the camshaft end. An electrically actuated adjusting mechanism drivingly connects the input and output members enabling selective angular adjustment of the output shaft while maintaining driving engagement between the input and output members. The adjusting mechanism may typically comprise a gearbox arrangement in the form of a planetary gear system or a harmonic drive.

Hence, electrically driven cam phasers comprise a relatively complex gearbox/reductor arrangement that must be manufactured with great care and precision to avoid locking and breaking of the gearings. Furthermore, the cam phaser, which is directly loaded by the sprocket wheel, is subject to important mechanical stresses and this is a cause of rapid wear and/or breaking of many cam phasers.

U.S. Pat. No. 6,328,006 e.g. describes a cam phaser with harmonic drive. U.S. Pat. No. 6,981,478 on the other hand describes a cam phaser with planetary gearing system.

OBJECT OF THE INVENTION

Hence, there is a need for an alternative design of variable cam phaser that is less sensitive to mechanical loads from the sprocket wheel.

SUMMARY OF THE INVENTION

This is achieved by a valve train with variable cam phaser as claimed in claim 1.

According to the present invention, there is provided a valve train for an internal combustion engine comprising a camshaft and a variable cam phaser mounted to the camshaft for driving the latter, wherein the engine comprises a crankshaft providing a drive torque to the variable cam phaser through a drive member coaxial with the camshaft. The variable cam phaser comprises an input shaft rotationally coupled to the drive member and an output shaft rotationally coupled to the camshaft and coaxial with the input shaft. Adjusting means drivingly connect the input and output shafts and are configured to enable the input and output shafts to be selectively, angularly adjusted while maintaining driving engagement therebetween, the adjusting means comprising an electric actuator for selectively operating the angular adjustment between the input and output shafts.

According to an important aspect of the invention, the input and output shafts are coupled to the crankshaft and camshaft via respective, rotationally stiff, flexible coupling means.

Hence, the present invention provides a cam phaser design where conventional rigid connections at the interface between the cam phaser and the sprocket wheel and camshaft, respectively, are avoided, which reduces or avoids the transmission of mechanical shocks, tensions and loads from the crankshaft to the cam phaser. This will consequently ensure a more reliable and longer operation of the cam phaser.

The valve train is thus advantageously designed so that all of the cam phaser components are situated on the same side of the rotationally stiff, flexible coupling means, i.e. on the cam phaser side. Therefore, there is no direct, rigid connection between the cam phaser adjustment mechanism and the sprocket wheel or the camshaft, avoiding strong mechanical tensions.

The term flexible coupling means is conventionally used herein to designate a coupling able to transmit torque while permitting some radial and axial and angular misalignment. It is however important that the timing may not vary in an uncontrolled manner so that the flexible coupling must be rotationally stiff (i.e. the coupling is torsionally rigid and thus not flexible in the torque transmitting direction).

Numerous designs of rotationally stiff, flexible couplings can be used for the coupling of the drive member to the input shaft and of the output shaft to the camshaft, with some adaptations if required. The design and selection of the coupling means may be made depending on the actual intensity of torque to be transmitted and on the allowable dimensions.

In a preferred embodiment, namely for reasons of compactness, the rotationally stiff, flexible coupling means is implemented as a curved teeth coupling. Accordingly, one of the input or drive shaft may be provided at its inner or outer periphery with axially extending teeth having curved ends that engage in-between splined teeth on the outer or inner periphery of the other of the input or drive shaft. Similarly, one of the output shaft or camshaft comprises, at its inner or outer periphery, axially extending teeth having curved ends that engage in-between splined teeth on the outer or inner periphery of the other of the output shaft or camshaft. As it will be understood by those skilled in the art, such coupling allows for a torsionally rigid torque transmitting coupling that permits some degree of misalignment or end movement (i.e. some radial/angular and axial displacement).

But other types of rotationally stiff, flexible couplings may alternatively be used such as, but not exclusively, for example: Oldham couplings, universal joints, etc.

Regarding the adjusting means, here also a variety of designs are possible, although harmonic drives or epicyclic/planetary gearing systems are common for this function. For example, adjusting means may comprise a planetary gearing system having a ring gear coupled to the input shaft, a sun gear rotatable by an electric motor and planet gears supported by a carrier coupled to the output shaft. As it will be clear to those skilled in the art, other configurations of planetary gearing systems are also possible.

Preferably, the camshaft comprises an adapter portion at a front end thereof, to which said cam phaser output shaft is coupled.

The cam phaser is advantageously arranged in a housing so that it can be handled as a self-contained device simply having a pair of coaxial input and output shaft interfacing with the sprocket and camshaft. Preferably the cam phaser is fixed by means of an annular rubber block surrounding its housing. Such rubber block absorbs small dimensional variations (e.g. miss-concentricity and miss-alignment) and permits an axial locking of the cam phaser, in particular when using a curved teeth coupling.

A return spring system may be associated with the cam phaser to ensure return of the cam phaser to a predetermined position.

Also, a stroke limiter system may be associated with the cam phaser to avoid excessive angular modification of the camshaft and thus of the valve timing. Various designs of stroke limiter are known in the art and can be easily adapted to operate with the present camshaft.

In addition, the present cam phaser may include a phase detector to determine the angular position of the camshaft as well as an electronic control unit to operate the electric actuator in accordance with phase information provided by an engine control unit based on engine parameters.

The present invention also concerns an internal combustion engine equipped with the present valve train.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
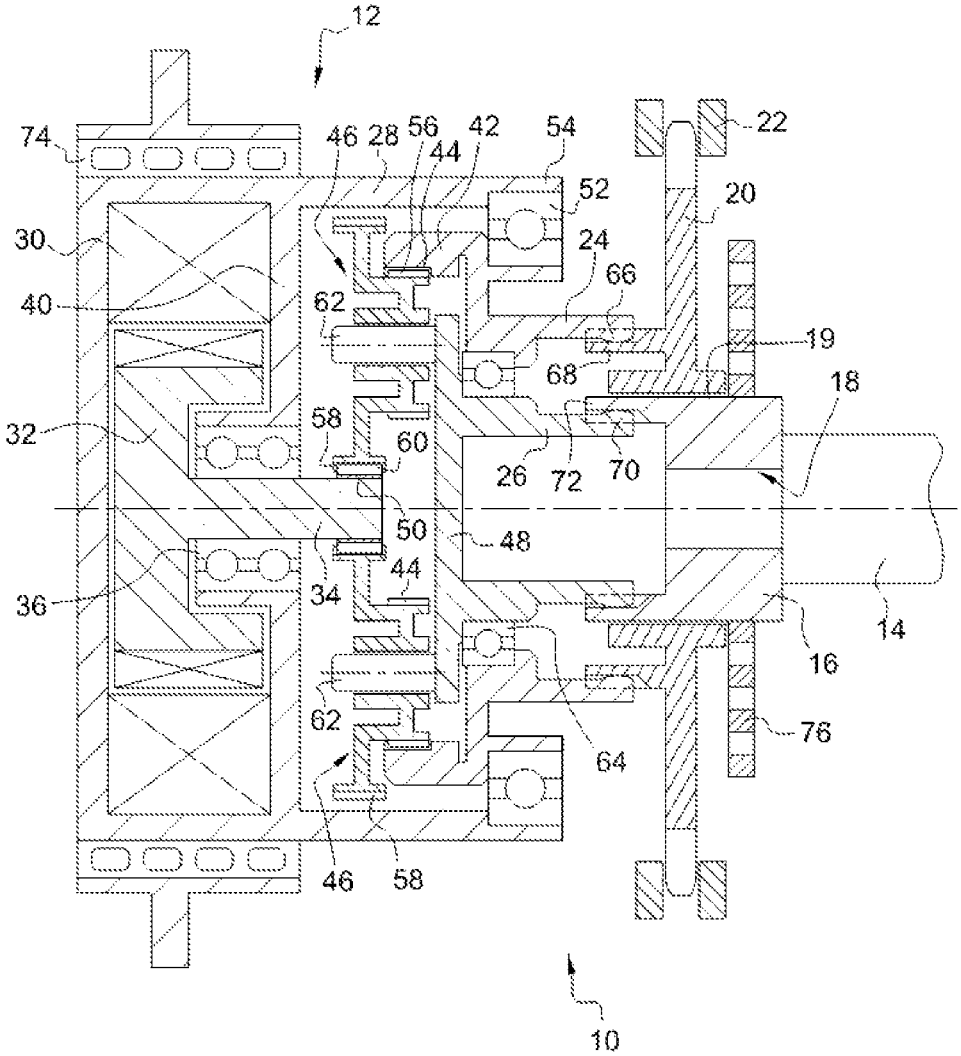
FIG. 1: is a section view through a preferred embodiment of the cam phaser attached to a camshaft end in a valve train according to the invention.

A preferred embodiment of the present valve train 10 is shown in FIG. 1 where a variable cam phaser 12 is mounted at a front end of a camshaft 14 of an internal combustion engine. In such valve train, the camshaft conventionally comprises a number of cams (not shown) interacting with cylinder valves (not shown) as it is well known. Conventionally, the camshaft 14, which is the driven member, comprises an adapter portion 16 fixedly attached to the camshaft 14 front end e.g. by means of a screw (not shown) through bore 18 (or the adapter portion 16 could be integrally formed with the camshaft 14). Reference sign 20 indicates a sprocket wheel 20 coaxial with the camshaft 14 and rotatably mounted on the adapter portion 16 by a journal bearing 19. The sprocket wheel 20 is, in a manner known per se, rotatably driven by the crankshaft (not shown) of the engine via a toothed drive belt or chain 22 and provides the drive torque to the cam phaser 12. The journal bearing 19 is preferably lubricated by oil dispensed by a channel in the adapter portion 16 arriving from the camshaft 14, as it is known in the art.

The cam phaser 12 comprises an input shaft 24 rotationally coupled to the sprocket wheel 20—forming the drive member—and an output shaft 26 rotationally coupled to the camshaft 14 via its adapter portion 16. The cam phaser 12 actually provides a connection between the sprocket wheel 20 and camshaft 14 that enables the camshaft 14 to be relatively angularly adjusted with respect to the sprocket wheel 20 while maintaining driving engagement therebetween, as will be described below.

Referring more specifically to the structure of the cam phaser 12, it is here designed as a self-contained device with a housing 28 in which an electrical DC motor and adjusting means are accommodated. The electric motor comprises an outer, electromagnetic stator 30 and a magnetic rotor 32 integral with a rotor shaft 34 rotatably supported by a pair of ball bearings 36 arranged in a through-bore 38 of a partition wall 40.

In the present variant, the adjusting means take the form of a planetary gearing system having a ring gear 42 with internal teeth 44 that cooperates with a set of four planet gears 46 (only two of them being shown). The planet gears 46 are mounted on a carrier 48 and are also in meshing engagement with a sun gear 50 fixedly mounted to the rotor shaft 34. As can be seen from FIG. 1, the ring gear 42 is rotatably supported by a roller bearing 52 fixed in a shoulder section 54 in the housing 28. The planet gears 46 are here designed as two-stage gears, i.e. they have a first external toothing 56 meshing with the teeth 44 of ring gear 42 and a second outer toothing 58 meshing with the external toothing 60 of the sun gear 50. The planetary gears are rotatably supported by pins 62 affixed to carrier 48, itself rotatable with respect to the sun gear 50 and rotationally integral with the output shaft 26.

It may be noted that the input shaft 24 and ring gear 42 are integrally formed and that the output shaft 26 is rotatably supported in a ball bearing 64 mounted on an inner wall of input shaft 24.

It is to be appreciated that torque transfer from the sprocket wheel 20 to the input shaft 24 and from the output shaft 26 to the camshaft 14 is carried out by means of respective rotationally stiff, flexible couplings. Such couplings are here implemented as curved teeth couplings arranged as two coaxial layers.

Figure 2:
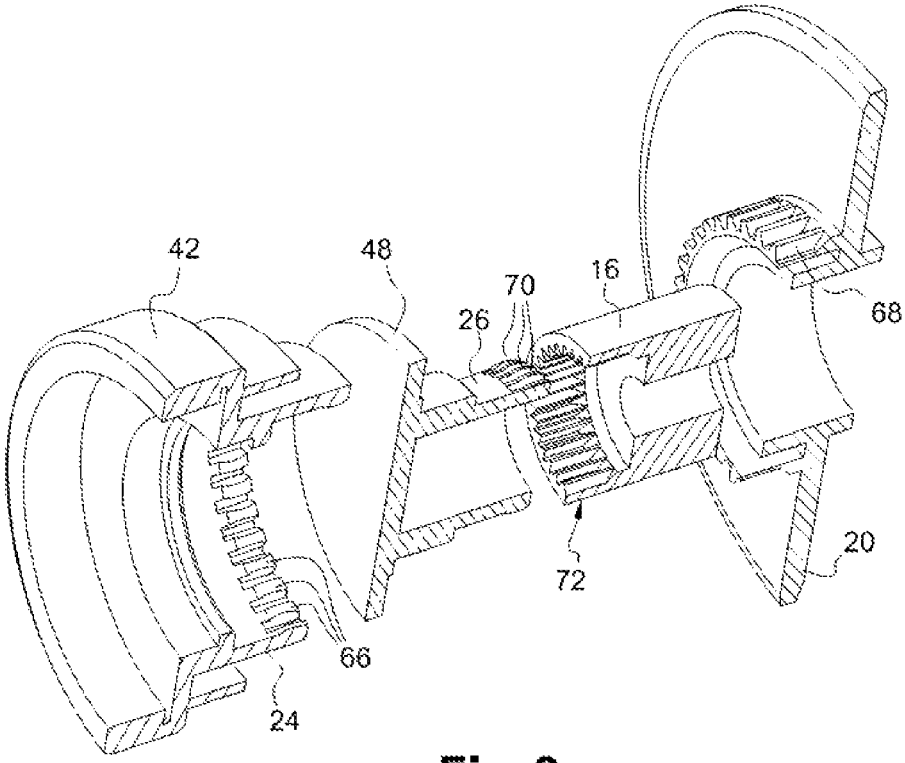
FIG. 2: is a schematic exploded view—also axially cut—of the couplings between drive member/input shaft and output shaft/cam shaft adapter.

As best seen in FIG. 2, the input shaft 24 comprises an internally splined end portion, where the axially extending splines 66 have an inwardly curved shape over at least part of their length. The input shaft splined portion meshes with an externally splined ring 68 that is integral with the sprocket wheel 20. Similarly, the output shaft 26 has an externally splined portion where the axially extending splines 70 have an outwardly curved shape over at least part of their length. These splines are in meshing engagement with an inwardly splined end portion 72 of adapter portion 16.

As it will be understood, this kind of curved teeth coupling provides a torsionally rigid coupling that however permits some degree of angular misalignment thanks to the curved teeth while the axial splines allow for some degree of axial displacement. Accordingly, an efficient and precise transmission of torque is achieved but the drive loads and vibrations from the sprocket are essentially not transmitted to the cam phaser 12. Actually, in the present configuration the chain (or belt) load is absorbed by the journal bearing 19 of the sprocket wheel 20.

Hence, the links between the camshaft and the sprocket wheel, respectively the camshaft, are not rigid and all the components involved in the angular adjustment mechanism are situated on the cam phaser side of the flexible couplings, which only serves for torque transfer in a "soft" manner.

Hence, no gearings of the cam phaser are subject to drive loads from the sprocket wheel.

When the engine is running and no valve timing modification is required, then the electric motor is not energized and the adjusting mechanism is simply driven along with the input shaft 24; no angular adjustment of the camshaft occurs, the sprocket wheel 20 and the camshaft 14 rotate at the same speed. To perform a variation of valve timing, the electrical motor is energized in order to cause the camshaft 14 to turn at a greater or slower speed than the sprocket wheel 20 in order to obtain the desired angular variation of the camshaft 14 corresponding to the desired valve timing. Considering the present configuration of the planetary gearing, the sun gear 50 forms the planetary's input and the output is the carrier 48. Energizing the electric motor in an appropriate speed will allow rotation of the output shaft 26 at a speed greater or slower than the input shaft 24 for a time period required to bring the camshaft 14 in the desired angular position and thus provide the desired valve timing.

Preferably, when using such axial splines, the cam phaser 12 is fixed in place via a rubber block 74 that dampens vibrations and takes up misalignments and angular defaults and also blocks the housing 28 in axial direction. Such rubber block 74 may be over-moulded around the pot-shaped housing 28.

As already mentioned, the cam phaser 12 is a self-contained device that can be easily mounted at a camshaft end. The electric motor and adjusting mechanism in completely integrated inside the housing that may thus simply be connected via its two interfaces: the input and output shaft 24 and 26, respectively. The configuration of the ring gear 42/input shaft 24 member and that of the carrier 48/output shaft 26 member also closes the housing 28.

Preferably, a return spring 76 is fixed between the sprocket and the stroke limiter to ensure return of the cam phaser to a predetermined position.

Also, a stroke limiter of conventional design may advantageously be used to avoid excessive rotation of the camshaft 14 relative to the sprocket wheel 20. This can be done by means of one or two pins (not shown) radially extending from the adapter portion 16 and cooperating with one or two circumferentially extending notches (not shown) in the sprocket hub, as it is known to those skilled in the art.

The invention claimed is:

1. A valve train for an internal combustion engine comprising a camshaft and a variable cam phaser connected to said camshaft for driving said camshaft, said engine comprising a crankshaft providing a drive torque for said variable cam phaser through a drive member coaxial with said camshaft, wherein said variable cam phaser comprises:

an input shaft rotationally coupled to said drive member;

an output shaft rotationally coupled to said camshaft and coaxial with said input shaft;

an adjusting means drivingly connecting said input and output shafts enabling said input and output shafts to be selectively, angularly adjusted while maintaining driving engagement therebetween, wherein the adjusting means comprise an electric actuator for selectively operating an angular adjustment;

wherein said input and output shafts are coupled to said drive member and camshaft via respective, rotationally stiff, flexible coupling means.

2. The valve train according to claim 1, wherein at least one of the rotationally stiff, flexible coupling means between said input shaft and drive member and between said output shaft and said camshaft is implemented as a curved teeth coupling.

3. The valve train according to claim 2, wherein one of said input or drive shaft is provided at its inner or outer periphery with axially extending teeth having curved ends that engage in-between splined teeth on the outer or inner periphery of the other of the input or drive shaft; and one of said output shaft or camshaft comprises, at its inner or outer periphery, axially extending teeth having curved ends that engage in-between splined teeth on the outer or inner periphery of the other of said output shaft or camshaft.

4. The valve train according to claim 1, wherein said adjusting means comprises a harmonic drive or planetary gearing system.

5. The valve train according to claim 4, wherein said adjusting means comprises a planetary gearing system having a ring gear coupled to said input shaft, a sun gear rotatable by an electric motor and planet gears supported by a carrier coupled to said output shaft.

6. The valve train according to claim 4, wherein said camshaft comprises an adapter portion at a front end thereof, to which said output shaft is coupled.

7. The valve train according to claim 1, wherein said variable cam phaser is arranged in a housing.

8. The valve train according to claim 7, wherein said variable cam phaser is fixed by means of an annular rubber block surrounding said housing.

9. The valve train according to claim 1, comprising a return spring associated with said cam phaser.

10. The valve train according to claim 1, comprising a stroke limiter system associated with said cam phaser.

11. An internal combustion engine comprising:

a camshaft and a variable cam phaser connected to said camshaft for driving said camshaft, said engine comprising a crankshaft providing a drive torque for said variable cam phaser through a drive member coaxial with said camshaft, wherein said variable cam phaser comprises:

an input shaft rotationally coupled to said drive member;

an output shaft rotationally coupled to said camshaft and coaxial with said input shaft;

an adjusting means drivingly connecting said input and output shafts enabling said input and output shafts to be selectively, angularly adjusted while maintaining driving engagement therebetween, wherein the adjusting means comprise an electric actuator for selectively operating an angular adjustment;

wherein said input and output shafts are coupled to said drive member and camshaft via respective, rotationally stiff, flexible coupling means.

* * * * *